US005277170A

United States Patent [19]

Carella

[11] Patent Number: 5,277,170

[45] Date of Patent: Jan. 11, 1994

[54] ARCHERY TRAINING DEVICE

[76] Inventor: Richard F. Carella, 35572 Strathcona Dr., Mt. Clemens, Mich. 48043

[21] Appl. No.: 913,862

[22] Filed: Jul. 15, 1992

[51] Int. Cl.[5] ..... F41B 5/00; A63B 21/00

[52] U.S. Cl. ..... 124/86; 124/80; 124/23.1

[58] Field of Search ..... 124/88, 86, 80, 23.1, 124/25.6, 26, 35.1, 31; 482/122, 124

[56] References Cited

U.S. PATENT DOCUMENTS

| | | | |
|---|---|---|---|
| 1,885,962 | 11/1932 | Swenson | 124/23.1 |
| 2,769,179 | 11/1956 | Love | 124/23.1 |
| 3,665,911 | 5/1972 | Altier | 124/35.2 |
| 4,887,584 | 12/1989 | Carella . | |
| 4,909,232 | 3/1990 | Carella | 124/35.1 |
| 5,009,216 | 4/1991 | Ross | 124/88 |
| 5,052,365 | 10/1991 | Carella . | |
| 5,065,732 | 11/1991 | Smith | 124/88 |
| 5,070,856 | 12/1991 | Plummer | 124/88 |
| 5,163,413 | 11/1992 | Carella | 124/88 |
| 5,165,584 | 11/1992 | Meagher | 124/88 |

*Primary Examiner*—Randolph A. Reese
*Assistant Examiner*—Anthony Knight
*Attorney, Agent, or Firm*—Remy J. VanOphem

[57] ABSTRACT

An archery training device for teaching an archer proper muscular control, muscle force and body positioning before, during, and after release of an arrow for promoting accurate shooting of the arrow with the bow. The archery training device promotes a push-pull balance between the archer's string arm elbow and bow hand throughout the shot while also providing feedback of this balance when shooting arrows. The archery training device includes a string arm connector which is securable to the string arm elbow and a bow hand connector that is secured to the bow hand of the archer so as not to interfere with the archer's grasp of the bow. An elastomeric force carrying member elastically extends between the string arm connector and the bow hand connector to create a constant tensional force between the string arm elbow and the bow hand when the archer is in the full draw position. Alternatively, a remote anchor may be positioned away from the archer, and by connecting the elastomeric force carrying member to the remote anchor a non-parallel constant tensional force may be created between the string arm, elbow and the bow hand. The muscles associated with the archer's upper body are thereby required to remain taut throughout the draw and release of the bowstring to maintain a proper push-pull balance throughout the shot, while also restraining the anchor hand, bow hand, string arm, and shoulders from movement that would adversely affect shooting accuracy. The archery training device allows the archer to practice shooting groups of arrows whose grouping patterns provide feedback to the archer relating to the archer's push-pull balance and upper body posture.

21 Claims, 6 Drawing Sheets

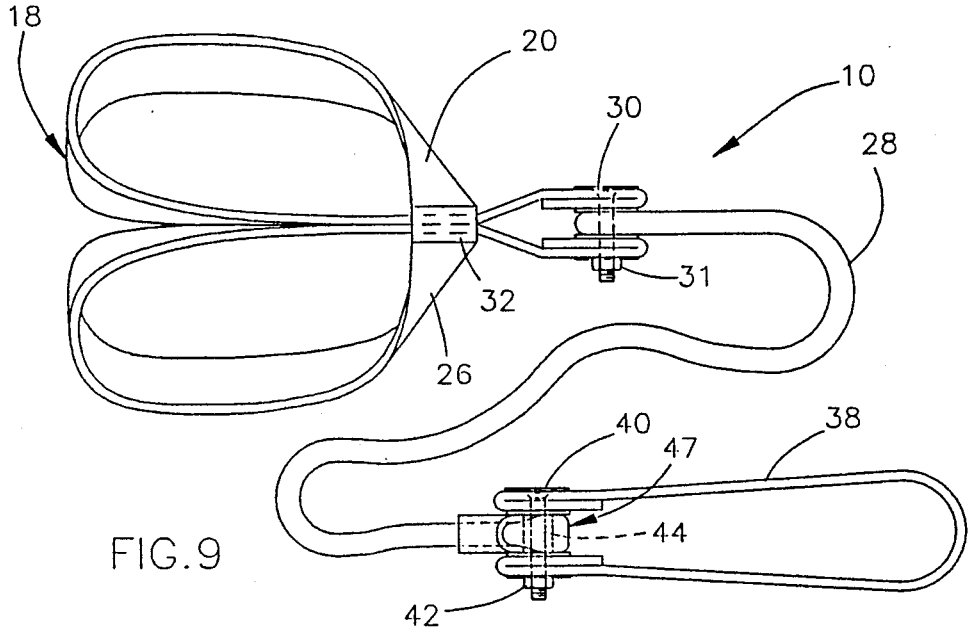
FIG. 9
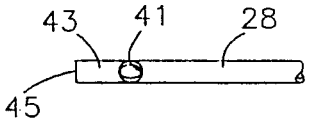
FIG. 15
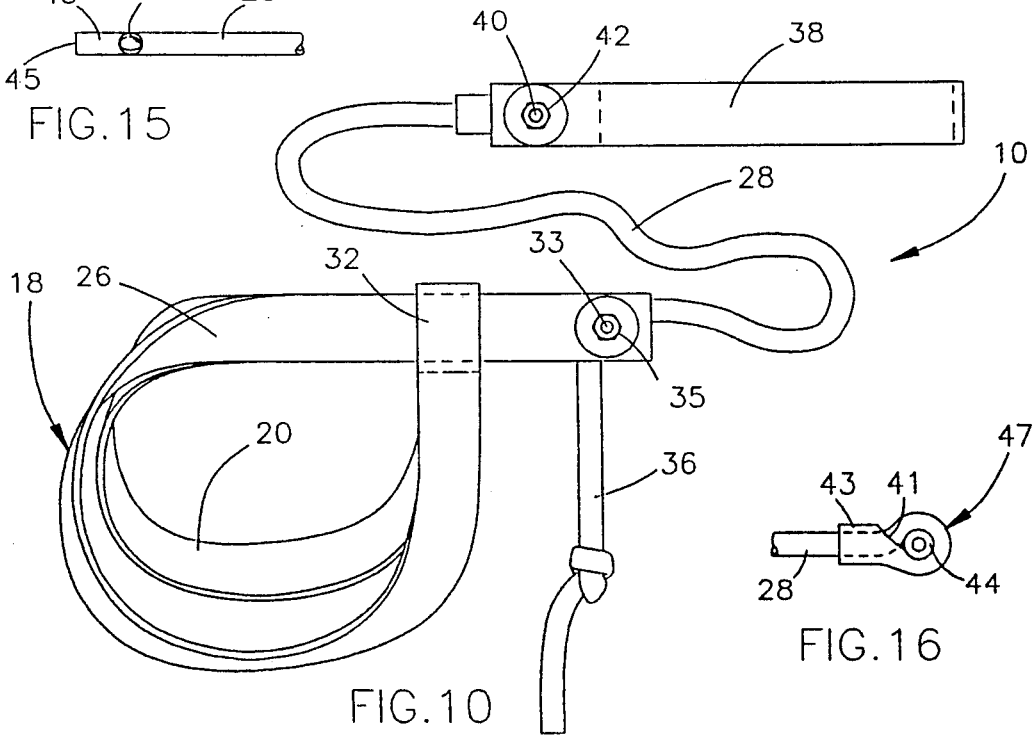
FIG. 10
FIG. 16

ARCHERY TRAINING DEVICE

BACKGROUND OF INVENTION

1. Field of the Invention

This invention relates to an archery training device for teaching an archer proper muscular control, muscle force and body positioning before, during, and after string release for accurate shooting of a bow and arrow. More specifically, the present invention promotes a balance between the archer's push-pull and the bow force while also providing feedback of this balance when shooting arrows.

2. Description of the Prior Art

An observer of an archer shooting a bow and arrow occasionally witnesses a flinching or collapsing of the archer's upper body during the process of releasing the bowstring. Obviously, such body movement or imbalance contributes to inconsistent and inaccurate shooting of an arrow with the bow. The importance of an archer practicing every day to improve his skills, and thereby minimize the tendency for collapse or imbalance has led to a need for training devices. For example, an archery training device was disclosed by Applicant in U.S. Pat. No. 4,887,584. However, U.S. Pat. No. 4,887,584 does not teach an archery training device that simultaneously allows an archer to shoot arrows in that a substantially inelastic force carrying member is employed. The inelastic force carrying member is suitable for isometric exercises, but artificially limits the archer's draw to the length of the inelastic force carrying member.

In contrast, U.S. Pat. No. 5,052,365, also in the name of Applicant, discloses an archery training device specifically adapted for use with a bow, with or without an arrow. However, using this archery training device with an arrow adversely affects the arrow's performance, making it unsuitable for use with an arrow for most practical purposes. U.S. Pat. No. 5,052,365 discusses in detail that the cause of this collapse is attributable to the archer having relaxed his or her upper back muscles during the initial stage of the shot so that the anchor hand (the hand used to draw the bowstring), bow hand, string arm elbow, or shoulders begin to move before the string fingers are completely free of the bowstring. This "reflex muscle relaxation" is an involuntary response, and, therefore, can only be shortened, but not eliminated entirely. To date, the above prior art has taught that compensation is possible under two approaches: shortening the period of time in which reflex muscle relaxation can influence the shot, and minimizing the effect of reflex muscle relaxation by improving the stance of the archer.

Ideally, for maximum stability while shooting an arrow, certain points of the archer's upper body frame should lie within a plane termed the "rigid frame plane". As can be seen in FIGS. 4 and 5, these points are the string arm or rear elbow joint 24 of the string arm 22, the anchor hand 34, the string or rear shoulder 23, the front shoulder 25 and the contact point of the bow hand 15 with the bow 14. The string arm elbow 24, the rear shoulder 23 and the contact point of the bow hand 15 with the bow 14 define the corners of a scalene triangle that establishes the rigid frame plane $\alpha$. An archer properly maintaining the rigid frame plane a during the reflex muscle relax time will reduce movement of the string or anchor hand 34, bow hand 15, string arm elbow 24, and shoulders 23 and 25 in a manner which will improve shooting accuracy.

FIG. 1 shows the string arm elbow joint 24, the anchor hand 34 superimposed on the bow hand 15, and the string shoulder 23, indicated by points A, B and C, respectively, lying in the rigid grame plane $\alpha$. Simultaneously, the anchor hand 34 and bow hand 15 lie in the bow plane $\beta$, which determines the lateral trajectory of the arrow. FIG. 2 illustrates a common defect in the stance of an archer 12 in which the string arm elbow 24 is outside the rigid frame plane $\alpha$ by some distance X. As a result, during the period in which the bowstring is being released, the anchor hand 34 ("B") is also forced out of the bow plane $\beta$, causing a significant error in the arrow's trajectory, as illustrated by FIG. 3.

In that the consequences of failing to attain the rigid frame plane $\alpha$ arise during the period between the beginning of the release of the bowstring and the time at which the string fingers are clear of the bowstring, this period is of primary importance in ascertaining the total effect of the rigid frame plane $\alpha$. This period, in which the upper back muscles relax before the string fingers are free of the bowstring, has been termed the "reflex muscle relax time". The reflex muscle relax time begins when the string fingers start to open and ends when they are free of the forward pull exerted by the bowstring.

In general, the shorter the reflex muscle relax time, the less opportunity there will be for the collapse or otherwise adverse movement of the archer's bow hand 15, anchor hand 34, string arm elbow 24, and shoulders 23 and 25 outside of the rigid frame plane $\alpha$. Consequently, a shorter reflex muscle relax time will enable the archer 12 to shoot more consistently and accurately even if the rigid frame plane $\alpha$ is not entirely achieved at the beginning of the shot. It also follows that proper muscular force and positioning of the anchor hand 34, string arm elbow 24, shoulders 23 and 25 and bow hand 15 within the rigid frame plane $\alpha$ during the reflex muscle relax time will also reduce the previously noted collapsing and imbalance of the archer's upper body, and thus promote more consistent and accurate shooting.

With reference again to FIGS. 4 and 5, the stance of the archer 12 at the start of the reflex muscle relax time is indicated at "D". As a result of failing to perfectly achieve the rigid frame plane $\alpha$ in conjunction with the reflex muscle relax time, the stance at the end of release, i.e. the end of the reflex muscle relax time, is altered as indicated at "E". Where no reflex muscle relax time occurs, the arrow's trajectory is indicated by a "zero relax line" 56. However, as a consequence of the inherent tendency to have reflex muscle relaxation and an imperfect rigid frame plane $\alpha$, the trajectory of the arrow is generally indicated by a "body relax line" 52.

U.S. Pat. No. 5,052,365, supra, provides an archery training device having an elastic member which is attachable to the archer's string elbow and the bowstring to induce a rapid increase in tension between the string elbow and the bow hand after release of the bowstring. The effect is to train the archer's muscles to remain taut throughout the shot to thereby minimize reflex muscle relaxation and thereby the adverse effect of the reflex muscle relax time. The archery training device provides the archer feedback regarding his or her upper body position and reflex muscle relax time after the bowstring release. This feedback is based on either an imbalance of forces exerted by upper back muscles which causes adverse movement of the anchor hand, bow hand, string arm elbow, and shoulders or an incorrect positioning of the bow hand, string arm elbow and shoulders. When the archer is properly positioned in the full draw position, the elastic member is positioned against his or her neck. However, if improper shifting of the upper body occurs during the shot due to a force imbalance, the elastic member shifts away from the side of the neck during release of the bowstring, a signal to the archer that he or she is not maintaining proper upper body positioning. If an arrow were to be shot at the time, this shifting would have an adverse effect on shooting accuracy. However, the device is not suitable for providing feedback when shooting an arrow because the elastic member is attached directly to the bowstring and the increasing tensional force generated by the elastic member on the bow string impairs the arrow's performance.

U.S. Pat. No. 4,887,584, supra, discloses a similar device with a first embodiment disclosing an inelastic force carrying member extended between the string arm elbow and the bowstring, while another embodiment includes an elastic member between the force carrying member and the bow handle to simulate the bow draw force in the archer's stance without the use of an actual bow. As with U.S. Pat. No. 5,052,365, these devices are intended for isometric exercise to train the archer's muscles to remain taut throughout the shot, which serves to minimize the effect of the reflex muscle relax time. However, the use of an inelastic force carrying member artificially limits the archer's draw to the length of the force carrying member. Even in the embodiment where an elastic member is attached between the force carrying member and the bow, the limited length of the elastic member provides almost negligible extension. Accordingly, none of the above devices are suitable for using when actually shooting an arrow, and all but the first embodiment is adapted for use without a bow.

In addition to the reflex muscle relax time, Applicant has determined that another critical aspect of shooting an arrow involves the push-pull balance between the bow hand 15 and the string arm elbow 24. More specifically, it is imperative that the pull force of the anchor hand 34 and the push force of the bow hand 15, which define a force line on the rigid frame plane $\alpha$, are balanced to assure stability and accuracy of the shot. Contrary to what one might think, the push and pull of the draw are independent of each other. As illustrated in FIG. 6, an archer's push-pull balance is defined with respect to the archer's spine 13. The front half push of the bowstring draw exists between the spine 13 and the bow hand 15, while the rear half pull of the draw exists between the spine 13 and the string elbow 24. The push-pull forces are designated to be either "dynamic" or "static." A dynamic force means contracting muscles that adapt to remain equal to the opposing bow force during bowstring release. A static force means contracting muscles that are less than the opposing bow force during bowstring release. The above is summarized in a pamphlet distributed by Applicant under the title "The Technical Side of Archery Form and the Formaster Training Device." R. F. Carella (1992), p. 5.

When balanced, the push-pull effect acts along the previously-noted body relax line 52 throughout the release cycle (unless zero reflex muscle relax time could be achieved —then, the push-pull effect would act along the zero relax line 56). Each half opposes the bow force with equal dynamic force during the release cycle. However, if each half of the push-pull does not have the same dynamic muscle force when the bowstring is released, the arrow's trajectory will follow a "force relax line" 54 which differs from the body relax line 52 as illustrated in FIGS. 7 and 8. FIG. 7 shows the effect of the pull being static, resulting in a collapse between the spine 13 and the string arm elbow 24 during the release of the bowstring, corresponding to the archer's aim being deflected to the left. FIG. 8 shows the effect of the push being static, resulting in a collapse between the spine 13 and the bow hand 15 during the release of the bowstring, corresponding to the archer's aim being shot to the right. In each case, the force relax line 54 deviates from the body relax line 52, thereby significantly affecting the arrow's trajectory, which compounds the effect of the reflex muscle relax time that establishes the body relax line 52.

It would be desirable to provide a device which can be used with an arrow, thereby enabling the use of the device during actual practice to improve the ability of the archer to maintain his or her push-pull balance in addition to sustaining the rigid frame plane while minimizing the reflex muscle relax time. U.S. Pat. No. 4,887,584, supra, was directed only at improving the stance for the rigid frame plane and muscle strengthening, and furthermore did not allow the use of an arrow. The archery training device taught by U.S. Pat. No. 5,052,365 was not suitable for shooting an arrow because the elastic member would impair the arrow's performance.

Accordingly, what is needed is an archery training device which aids in maintaining the push-pull balance of an archer's stance while also reducing the effects of the reflex muscle relax time and promoting proper positioning of the bow hand 15, string arm elbow 24, and shoulders 23 and 25 of the archer 12 within the rigid frame plane $\alpha$ when he or she is drawing and releasing the bowstring. In addition, what is needed is such an archery training device that will achieve the above aspects while also permitting the archer to shoot an arrow to allow the placement of the arrow to serve as a distinct form of feedback as to his or her push-pull balance and stance.

SUMMARY OF THE INVENTION

The archery training device of the present invention is directed at teaching an archer proper upper body muscular control, push-pull balance, and positioning while shooting an arrow with a bow. In particular, the archer is intended to use the archery training device when shooting a group of arrows at a target, then shooting a second group of arrows at the target without the archery training device. Any spatial difference in the arrow groupings indicates incorrect push-pull balance and excessive reflex muscle relaxation time. Initially, the archer will normally shoot tighter arrow groups with the archery training device. But with sufficient practice using the archery training device of the present invention, the archer will become able to place both groups of arrows in the target, indicating that the correct push-pull balance and reflex muscle relaxation time has been achieved. Through muscle memory, the archer will be able to shoot tight arrow groups without the archery training device.

In addition, the archery training device promotes proper positioning and muscle force of the archer's shoulders, string arm elbow, anchor hand, bow arm and bow hand along the rigid frame plane such that collapse of the string arm and bow arm is minimized during and after release of the arrow. Importantly, the proper muscle force sought is the push-pull balance between the archer's bow hand and string arm elbow to avoid collapse of the front or rear half of the archer's stance during the release cycle. Such a collapse would otherwise cause shooting errors due to the archer's body being moved left-right or up-down relative to the intended target. Moreover, the archery training device actually promotes the proper stance, push-pull balance and reflex muscle relax time. Alternatively, the device can be used without a bow or as an exercise device with a side force anchor attachment, or in the alternative the side force may be provided by a person, which induces temporary muscle memory that will enable the archer to retain the correct muscle force for proper push-pull balance when shooting an arrow immediately thereafter.

In the preferred embodiment, the archery training device includes a string arm connector which has a pair of loops, one being an upper loop securable to the upper arm of the archer's string arm proximate the elbow, and the other being a lower loop which is securable to the forearm of the archer's string arm proximate the elbow. Together, the loops cooperate by straddling the string arm elbow to prevent shifting of the string arm connector about the elbow.

Attached to the string arm connector is an interconnecting member formed from an elastomeric material. The interconnecting member is also attached to a bow hand connector. The elastic nature of the interconnecting member specifically provides sufficient extension between the string arm connector and the bow hand connector so as not to interfere with the draw of the bowstring. In the preferred embodiment, the bow hand connector is a glove worn on the archer's bow hand, allowing both the bow and the bowstring to be free to shoot an arrow. In use, the interconnecting member is extended between the string arm connector and the bow hand glove when the archer expands the draw to shoot an arrow with the bow. The interconnecting member is then elastically extended by the use of a remote anchor or by the influence of a person to create a constant tensile force between the string arm elbow and the bow hand, forcing the muscles of the upper back, shoulders, string arm, bow arm and bow hand to remain taut to reduce movement of the shoulders, string arm elbow and bow hand off the rigid frame plane. Training the muscles to remain taut also assists in preventing the collapse of the string arm and bow arm during and after release of the arrow.

The preferred embodiment of the present invention also entails attaching the interconnecting member to a remote anchor, fixed or provided by a person, to induce tensile forces upon the string arm elbow and the bow hand which are not parallel to the bow force. However, the invention may also be practiced by providing an interconnecting member of a predetermined length so as to exert a predetermined force parallel to the line of sight. The remote anchor provides side forces whose lateral force components force the archer to maintain upper body tautness.

In addition, the tensile forces acting upon the string arm elbow and the bow hand maintain the dynamic push-pull balance between the bow hand and the string arm elbow. As a result, the upper back muscles are forced to continue to push and pull throughout the shot, thus training the upper back muscles to shorten reflex muscle relax time by inhibiting collapse of the upper back muscles, shoulders and string arm elbow. Contrary to the prior art, the tensile forces imposed by the archery training device of the present invention are constant, requiring muscle tautness to resist the bow force throughout the shot, from the initial stage of the draw until the arrow has left the bow and the archer is free to lower the bow. These constant tensile forces increase the draw force when at full draw, having very little effect for compound shooters and a greater effect on recurve shooters. The muscle force throughout the shot requires that the push-pull balance on the bow also be maintained even as the string arm fingers are releasing the arrow.

A particularly important feature of the present invention is that the archery training device provides the archer feedback pertaining to his or her push-pull balance, upper body position and reflex muscle relax time before, during and after the bowstring release. The feedback is based on an imbalance of forces exerted by the upper back muscles which causes adverse movement of the bow hand, string arm elbow, and shoulders or an incorrect positioning of the bow hand, string arm elbow and shoulders. The feedback is two-fold. First, the interconnecting member will move up or down or away from the side of the neck as a result of a force imbalance or improper upper body positioning. Second, in using the archery training device while shooting an arrow group, and subsequently shooting an arrow group without the archery training device, the archer can assess his or her progress by noting the tightness and spatial relationship of each arrow grouping. A correct push-pull balance and reflex muscle relax time is indicated when each arrow group is tight and at the center of the target.

According to a preferred aspect of this invention, by using the archery training device, the archer's upper back develops a "muscle memory" of the shortened reflex muscle relax time which enables him to shoot this shortened reflex without the training device. Continuous feedback by the interconnecting member within the rigid frame plane develops muscle memory allowing for duplication of this correct position without the training device during subsequent shooting.

In addition, a significant advantage of the present invention is that the tensile forces exerted by the interconnecting member continue throughout the draw and release of the bowstring, requiring the archer to maintain the rigid frame plane and push-pull balance before, during and after the shot. The tensile forces teach the correct muscle force for each half of the archer to balance the push-pull, while also shortening the reflex muscle relax time. In the preferred embodiment, these tensile forces can be adjusted to suit the particular archer and type of bow by repositioning the archer relative to the remote anchor.

Finally, an added advantage to the archery training device is that it is particularly adapted to be used while shooting an arrow. The interconnecting member is extended between the string arm elbow and the bow hand so as not to interfere with the bow string and the bow. Moreover, no forces are imposed directly upon the bow that would affect arrow performance. Permitting use of the device while shooting an arrow provides the archer with immediate and positive feedback as to his or her reflex muscle relax time, rigid frame plane and push-pull balance. The feedback consists of the actual placement of the arrows on the target. Given the manner in which the arrows are placed and grouped, the archer is informed as to which particular area he or she needs to emphasize to improve the accuracy and consistency of his or her shot.

Accordingly, it is an object of the present invention to provide an archery training device which is capable of promoting proper positioning of an archer's anchor hand, bow hand, string arm elbow and shoulders so that they are coplanar.

It is a further object of the invention that such an archery training device be capable of promoting proper muscular control in the archer's upper back throughout the shot, from the time the bowstring is drawn until the arrow has cleared the bow.

It is still a further object of the invention that such an archery training device provide feedback to the archer, promoting reduced movement of the archer's anchor hand, bow hand, string arm elbow and shoulders during and after the release of the bowstring.

It is another object of the invention that the archery training device force the archer to maintain proper push-pull balance throughout the shot to prevent collapse of the archer's bow hand, string arm and shoulders after release of the bowstring.

It is yet another object of the invention that the archery training device be adapted for use while actually shooting an arrow.

It is still another object of the invention that such an archery training device with repeated use will develop muscle memory in the archer such that the archer will duplicate proper posture, muscle control and muscle force when not using the training device during actual shooting.

Other objects and advantages of this invention will be more apparent after a reading of the following detailed description taken in conjunction with the drawings provided.

BRIEF DESCRIPTION OF THE DRAWINGS

FIG. 9 is a top view of an archery training device constructed in accordance with a first embodiment of the present invention;

FIG. 10 is a side view of an archery training device constructed in accordance with a second embodiment of the present invention;

FIG. 9 or 10 is worn on the archer's bow hand;

FIG. 9 or 10 is worn and used by the archer in accordance with preferred aspect of the present invention;

FIG. 15 is a side view of an end of the elastomeric force carrying member prior to assembly in accordance with a preferred aspect of the present invention;

FIG. 16 is a side view in partial cross-section of the end of the elastomeric force carrying member of FIG. 15 after assembly showing a preferred manner of assembly in accordance with a preferred aspect of this invention.

DETAILED DESCRIPTION OF THE PREFERRED EMBODIMENT

Figure 1:
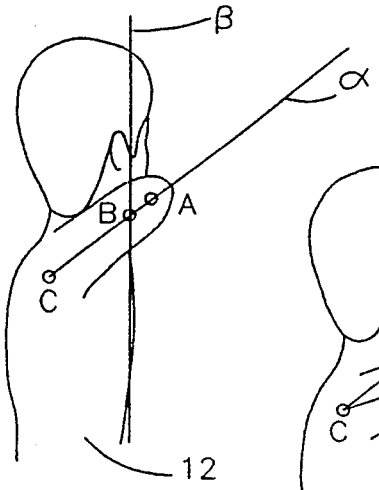
FIG. 1 is a rear view of an archer showing the archer's rear shoulder, string arm elbow and anchor hand positioned in the rigid frame plane.
Figure 2:
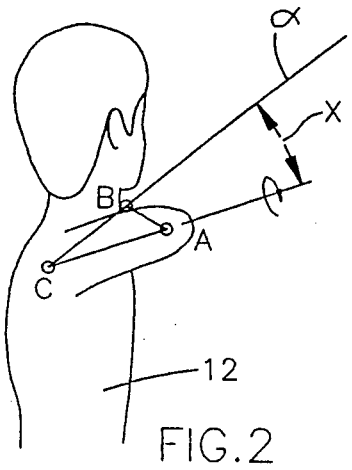
FIG. 2 is a rear view of an archer showing the archer's string arm elbow lying outside the rigid frame plane.
Figure 3:
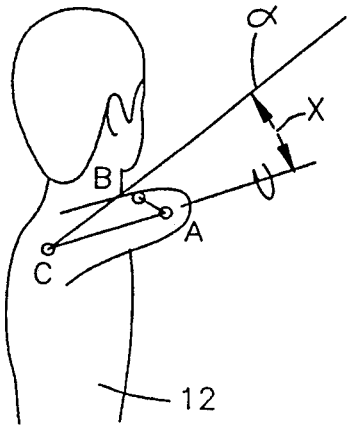
FIG. 3 is a rear view of the archer showing the result of the archer's stance of FIG. 2 as a consequence of the reflex muscle relax time during the release of the bowstring.
Figure 11:
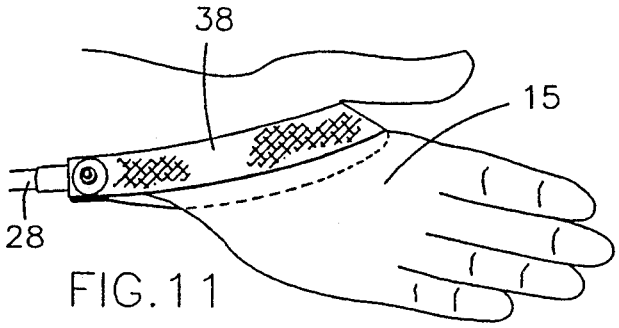
FIG. 11 illustrates the manner in which the archery training device of either
Figure 12:
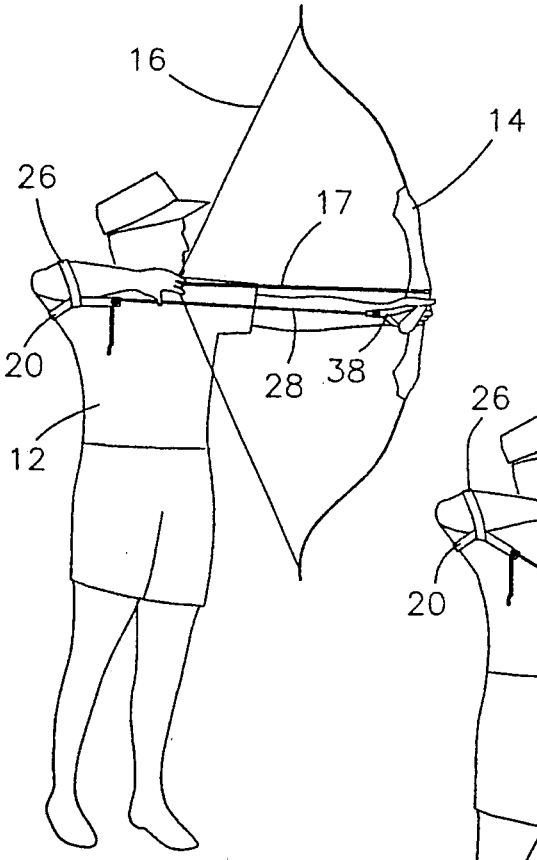
FIG. 12 illustrates the manner in which the archery training device of either

With reference to FIGS. 9, 11 and 12, there is shown an archery training device 10 according to a first embodiment of the present invention. Throughout the following description of the archery training device 10, continued reference will be made to concepts embodied in FIGS. 1 through 8. As described previously, FIGS. 1 through 3 are rear views of an archer 12 illustrating the rigid frame plane $\alpha$ and the coplanar relationship of points on the archer's string arm elbow A, the anchor hand superimposed on the bow hand (together identified as point B), and the string shoulder C. Seen as profile D in FIGS. 4 and 5, for best accuracy and consistency in shooting the anchor point (34) B, the string arm elbow (24) A, the contact point of the bow hand (15) to the bow (14) B, and the bow (front) and string (rear) shoulder joints 25 and 23 should be coplanar on the rigid frame plane $\alpha$ in the full draw position. When all such points are positioned so that they are coplanar, forces created by the bowstring 16 being drawn do not move the bow hand 15 or anchor hand 34 as much from the intended trajectory (the zero relax line 56) of the arrow during the reflex muscle relax time.

Figure 4:
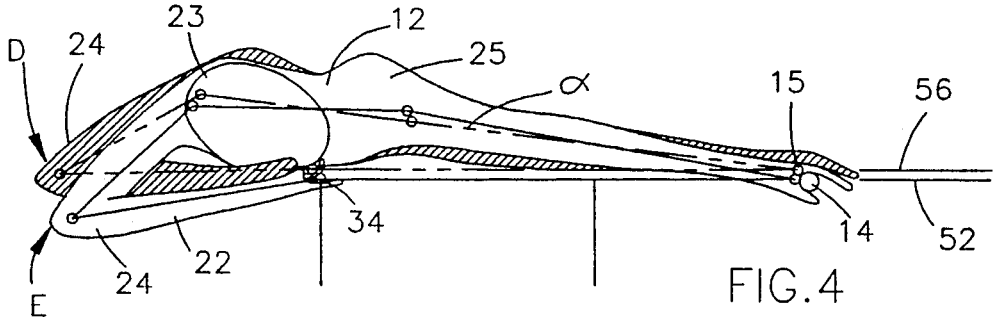
FIG. 4 is a top view of an archer in which the effects of the reflex muscle relax time are illustrated relative to the zero relax line.
Figure 5:
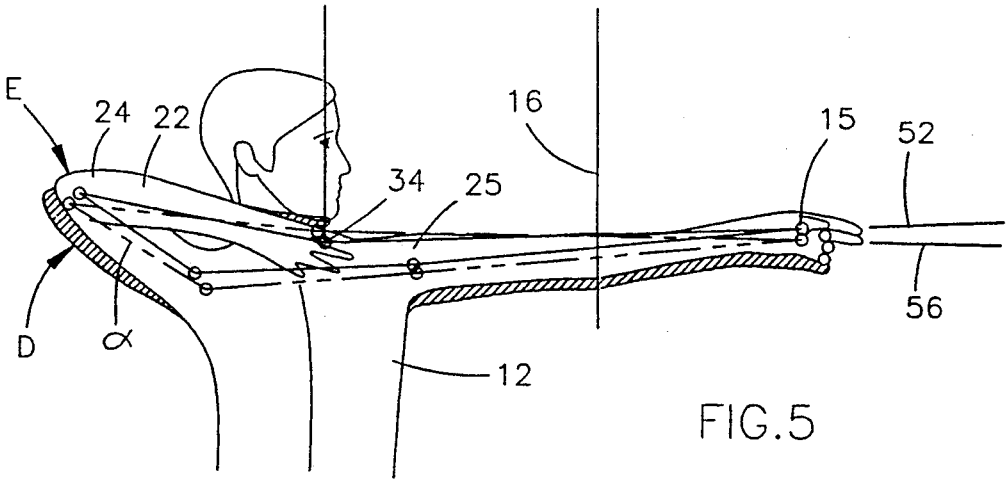
FIG. 5 is a side view of the archer of FIG. 4.

As seen by profile E in FIGS. 4 and 5, if not aligned in a coplanar relationship before release of the bowstring 16, the bow hand 15, the string arm elbow 24 and the anchor hand 34 have a tendency to move during the reflex muscle relax time, thus causing the archer's aim to deviate from the intended trajectory (the zero relax line 56), as evidenced by the body relax line 52, adversely affecting shooting accuracy. Even a small amount of movement caused by a resultant force due to the string arm elbow 24 being below the rigid frame plane $\alpha$ will tend to move the anchor hand 34 during the reflex muscle relax time, thus causing inaccuracy in shooting.

Figure 6:
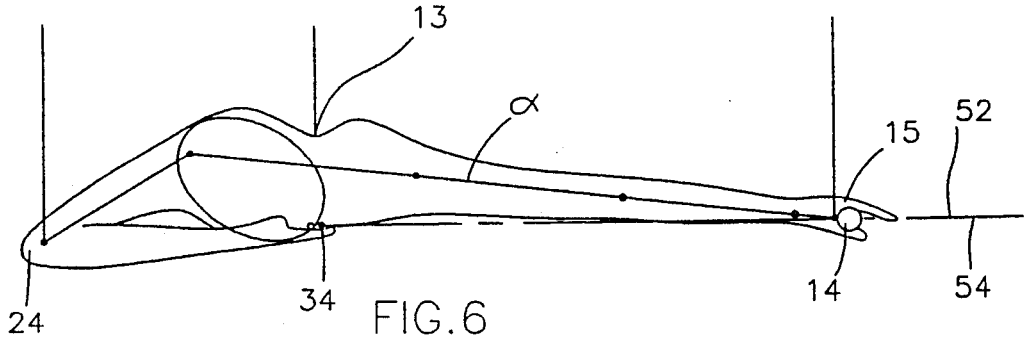
FIG. 6 is a top view of an archer showing the effect of a proper push-pull balance.
Figure 7:
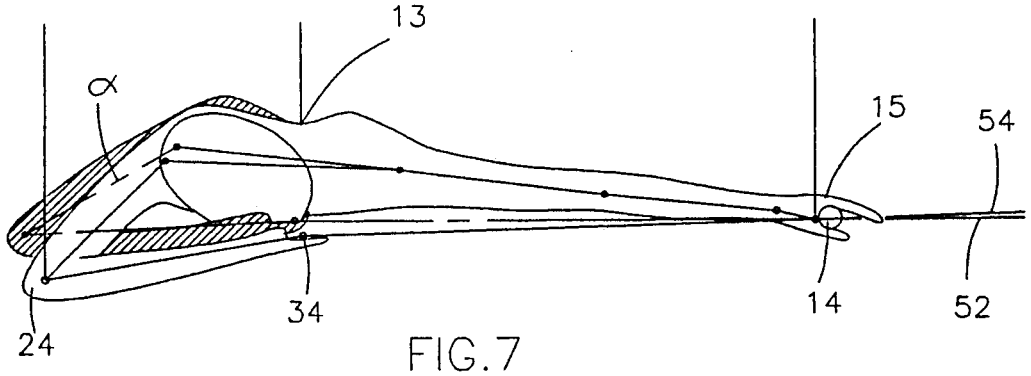
FIG. 7 is a top view of an archer showing the effect of an improper push-pull balance in which the rear half of the archer is providing only a static force opposing the bow force.
Figure 8:
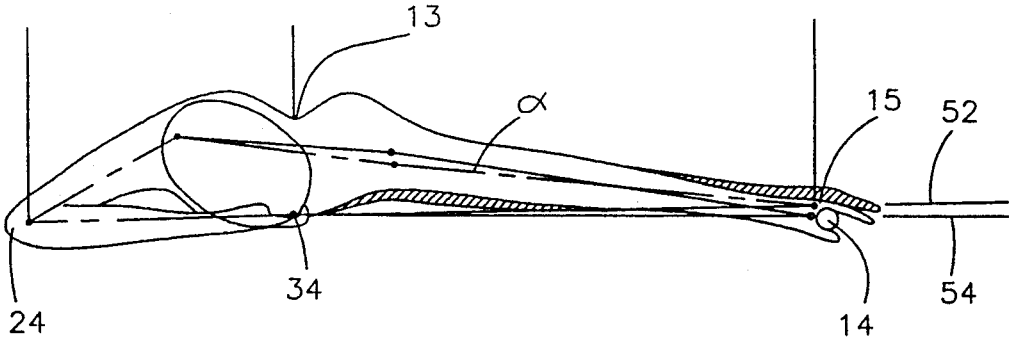
FIG. 8 is a top view of an archer showing the effect of an improper push-pull balance in which the front half of the archer is providing only a static force opposing the bow force.

FIGS. 6 through 8 illustrate the previously described effect of maintaining the proper push-pull balance between the bow hand 15 and the string arm elbow 24. It is imperative that the pull force of the anchor hand 34 and the push force of the bow hand 15, which define a force line on the rigid frame plane $\alpha$, are balanced throughout the shot to assure stability and accuracy of the shot. The push and pull of the draw are independent of each other, and are designated to be either "dynamic" or "static". As noted before, a dynamic force means contracting muscles that adapt to remain equal to the opposing bow force during bowstring release, while a static force means contracting muscles that are less than the opposing bow force during bowstring release. In that the dynamic push-pull balance is dependent upon the archer's ability to maintain a muscular force balance between the front and rear halves of his or her stance, a weaker archer is generally more prone to imbalance than a stronger archer.

When balanced, the push-pull effect acts along the previously-noted body relax line 52 throughout the release cycle (unless zero reflex muscle relax time could be achieved—then, the push-pull effect would act along the zero relax line 56). Each half opposes the bow force with the same dynamic force during the release cycle. However, if each half of the push-pull does not have the same dynamic muscle force when the bowstring is released, the arrow's trajectory will follow the force relax line 54 which differs from the body relax line 52 as illustrated in FIGS. 7 and 8. In each case, the force relax line 54 deviates from the body relax line 52, thereby significantly affecting the arrow's trajectory, which compounds the effect of the reflex muscle relax time that establishes the body relax line 52.

The archery training device 10 shown in FIG. 9 aids an archer in overcoming the above defects by imposing a constant tensional force between the archer's string arm and bow hand that serves to keep the muscles of the back, arms and hands taut before, during and after the shot. As a result, this muscular tension prevents the collapse of the front and rear halves of the archer's stance after the bowstring 16 has been released. In effect, the collapse of the archer's shoulders 23 and 25, string arm elbow 24, anchor hand 34 and bow hand 15 is prevented after release of the bowstring 16 by forcing the archer 12 to maintain the appropriate push-pull balance throughout the shot. As noted previously, failure to maintain the push-pull balance has as its primary consequence the effect of pulling the arrow grouping to one side or the other of the target, depending upon which half of the archer has collapsed. As a secondary effect, the archer's consistency is adversely affected, as indicated by the inability to shoot a tight arrow grouping. Typically, an archer will unknowingly resort to altering his or her sight to compensate for the push-pull balance error. However, the archer will be unable to compensate for the inconsistency, which is inherent with a partial collapse of the archer's stance in which the archer's string arm elbow 24, shoulders 23 and 25, bow hand 15 and/or anchor hand 34 fall outside of the rigid frame plane $\alpha$.

With particular reference to FIG. 9, the archery training device 10 according to a first embodiment of the present invention includes a string arm connector 18, a bow hand connector 38 and an elastomeric force carrying member 28 interconnecting the string arm connector 18 and the bow hand connector 38. The string arm connector 18 includes an upper loop 20 and a lower loop 26 which are securable to the upper arm and forearm, respectively, of the archer's string arm 22 proximate the string arm elbow 24. The upper and lower loops 20 and 26 are preferably formed from an inelastic material which is both strong and durable, such as nylon. The upper and lower loops 20 and 26 are joined together at one end by a slip loop 32. The slip loop 32 allows slidable adjustment in the size of the upper and lower loops 20 and 26 to accommodate archers of differing builds. As best seen in FIG. 12, the loops 20 and 26 together cooperate to straddle the string arm elbow 24 to prevent unwanted shifting of the archery training device 10 about the string arm elbow 24, and thereby promote operational safety.

In the first embodiment shown in FIG. 9, the upper and lower loops 20 and 26 are permanently joined at an end opposite the slip loop 32 by a fastener 30 and retainer 31. The fastener 30 also serves as an anchor for the attachment of the elastomeric force carrying member 28 to the string arm connector 18. In a second embodiment shown in FIG. 10, the upper and lower loops 20 and 26 are adjustably joined at one end by a threaded fastener 33 and threaded nut 35. The use of the threaded fastener 33 and threaded nut 35 permits adjustment of the length of the elastomeric force carrying member 28, as indicated by the additional adjustment length 36 extending from the fastener 33.

Figure 17:
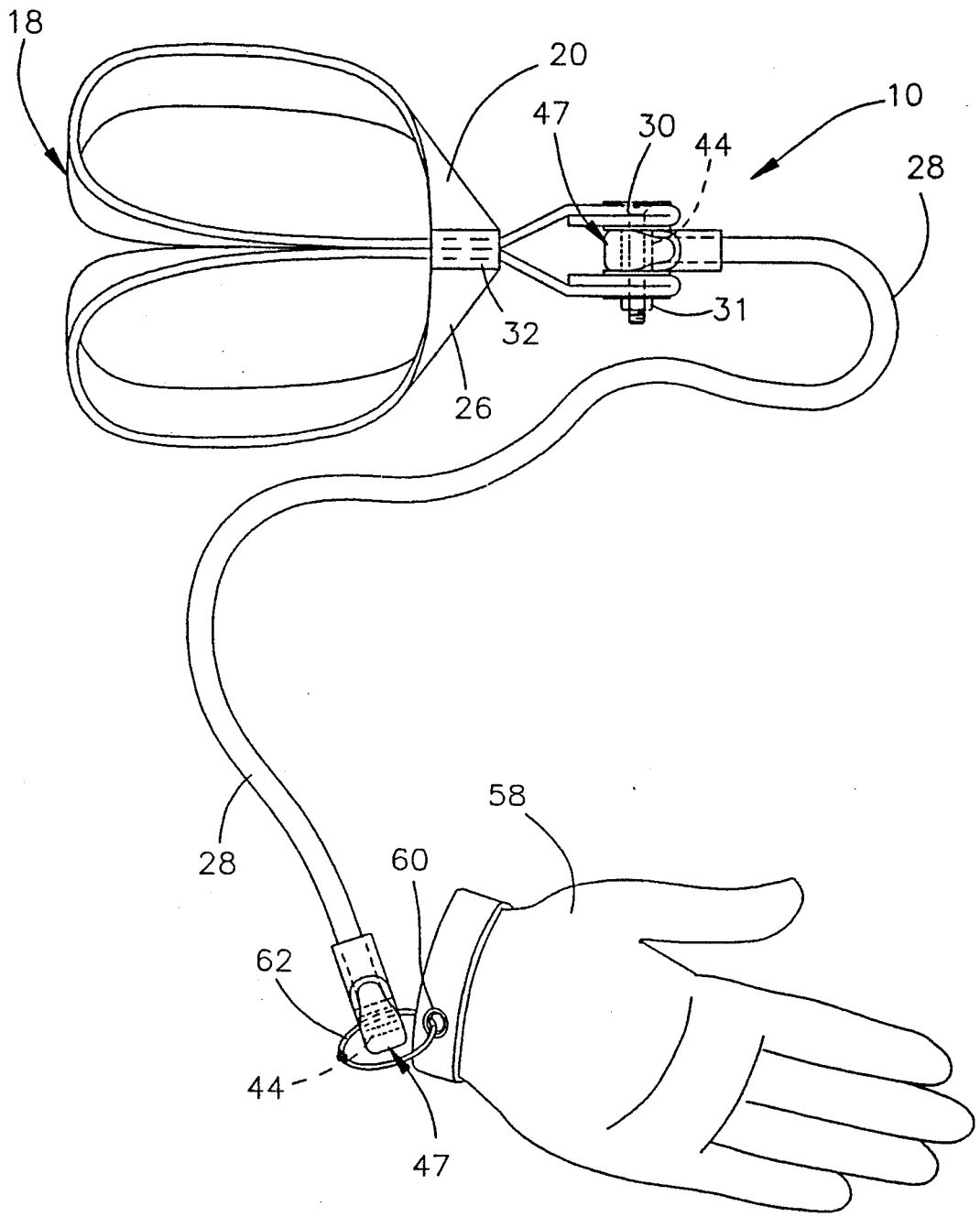
FIG. 17 is a top view of the archery training device of FIG. 13 constructed in accordance with the preferred embodiment of the present invention, wherein the bow hand connector is a glove.

With reference now to both FIGS. 9 and 10, the bow hand connector 38 is shown as a loop which is also preferably formed from a suitable inelastic material, such as nylon. More preferably, as shown in FIG. 17 as the preferred embodiment, the bow hand connector 38 is a glove 58 which is made from a suitably inelastic and durable material. The glove 58 is modified to incorporate a grommet 60 on its cuff. The elastomeric force carrying member 28 is attached to the grommet 60 with a slotted ring 62 which permits the glove 58 to be readily detached from the elastomeric force carrying member 28. Alternatively, in the embodiments of FIGS. 9 and 10, the bow hand connector 38 is secured to the elastomeric force carrying member 28 with a fastener 40 and retainer 42, similar to the first embodiment for the string arm connector 18. The bow hand connector 38 is sized to fit the bow hand 15 of the archer 12, as illustrated in FIGS. 11 and 12.

Figure 13:
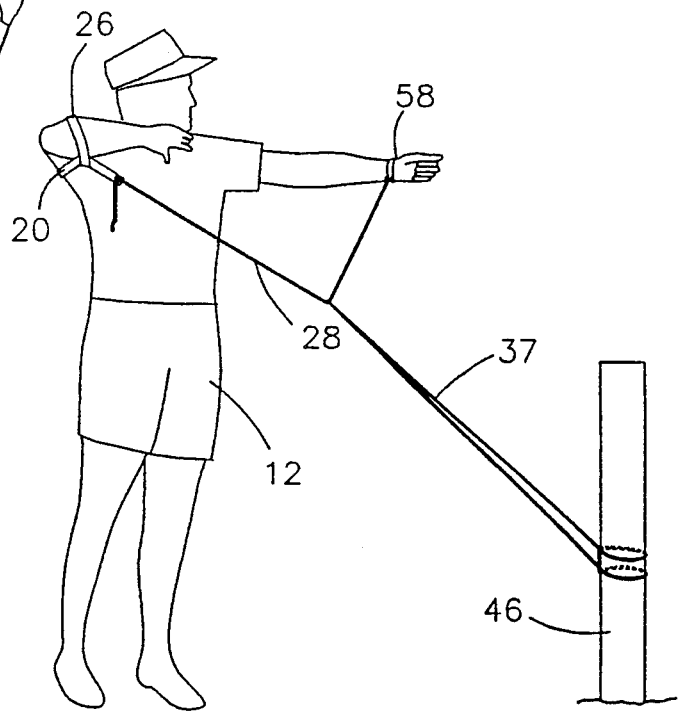
FIG. 13 illustrates the manner in which an archery training device is worn by the archer in accordance with a third and preferred embodiment of the present invention.

As noted above, the elastomeric force carrying member 28 is attached to the string arm connector 18 with the fastener 30 or 33 and the bow hand connector 38 with the fastener 40, or with the slotted ring 62 when the bow hand connector 38 is the glove 58. The elastomeric force carrying member 28 is preferably tubular and formed from a highly elastic material, such as a silicone or latex rubber often used for surgical rubber tubing. The elastomeric force carrying member 28 permits an elastic extension between the string arm connector 18 and the bow hand connector 38 to provide a tensional force therebetween while the bow 14 is drawn, such as is shown in FIG. 12 which illustrates the bowstring 16 in a full draw position. In the alternative, a remote anchor, as shown in FIG. 13, is utilized to provide the tensile force. In effect, the elastomeric force carrying member 28 extends between the string arm elbow 24 and the bow hand 15 to create the constant tensional force therebetween.

The force generated by the elastomeric force carrying member 28 is preferably at least 1 pound force at full draw, and more preferably approximately 4 to 5 pounds force at full draw. In use, this magnitude of constant resistance has been found to be sufficient to require that the archer's upper body remains taut, particularly with respect to maintaining a dynamic push-pull balance between the bow hand 15 and the string arm elbow 24. This constant tensional force is sustained as long as the archer's string arm elbow 24 is drawn back in the position shown, which is the situation throughout the shot, from the time the bowstring 16 is drawn until the arrow 17 clears the bow 14. Accordingly, there is a constant tensional force between the string arm elbow 24 and the bow hand 15 even after release of the bowstring 16 to maintain the archer 12 in a stance that requires constant muscular tension that sustains the push-pull balance of FIG. 6.

The constant tensional force imposed by the elastomeric force carrying member 28 causes a pulling force upon the muscles associated with the upper back which position the archer's anchor hand 34, bow hand 15, string arm elbow 24, and shoulders 23 and 25. It is this constant tensional force associated with the stretched configuration of the archery training device 10 which exercises these muscles to maintain a memory position so as to maintain the dynamic push-pull balance while also minimizing movement and muscle relaxation during release of the bowstring 16. As a result, the upper back muscles are trained through muscle memory to maintain the proper push-pull balance and shorten the reflex muscle relax time by inhibiting collapse of the upper back muscles, shoulders 23 and 25 and string arm elbow 24. Muscle memory induced by sufficient practice with the archery training device 10 enables the archer to later shoot with the proper push-pull balance and a shortened reflex muscle relax time without the archery training device 10.

In a third and preferred embodiment shown in FIG. 13, the archery training device 10 of FIG. 17 is combined with a rope segment 37 attached to a point on the elastomeric force carrying member 28 as a remote anchor. The rope segment 37 is then anchored to the ground with a suitable post 46. Preferably, the post 46 is located to the right for a right-handed archer 12, and to the left for a left-handed archer 12, to induce a pair of side or lateral force components relative to the bow force line upon the anchor hand 34 and the bow hand 15. The constant tensional force components upon the string arm elbow 24 and bow hand 15, induced by the lateral forces imposed on the archer 12 challenges the archer 12 to maintain upper body tautness, particularly with respect to maintaining a dynamic push-pull balance throughout the shot. It is foreseeable that the function of the remote anchor may be provided by a person.

Figure 14:
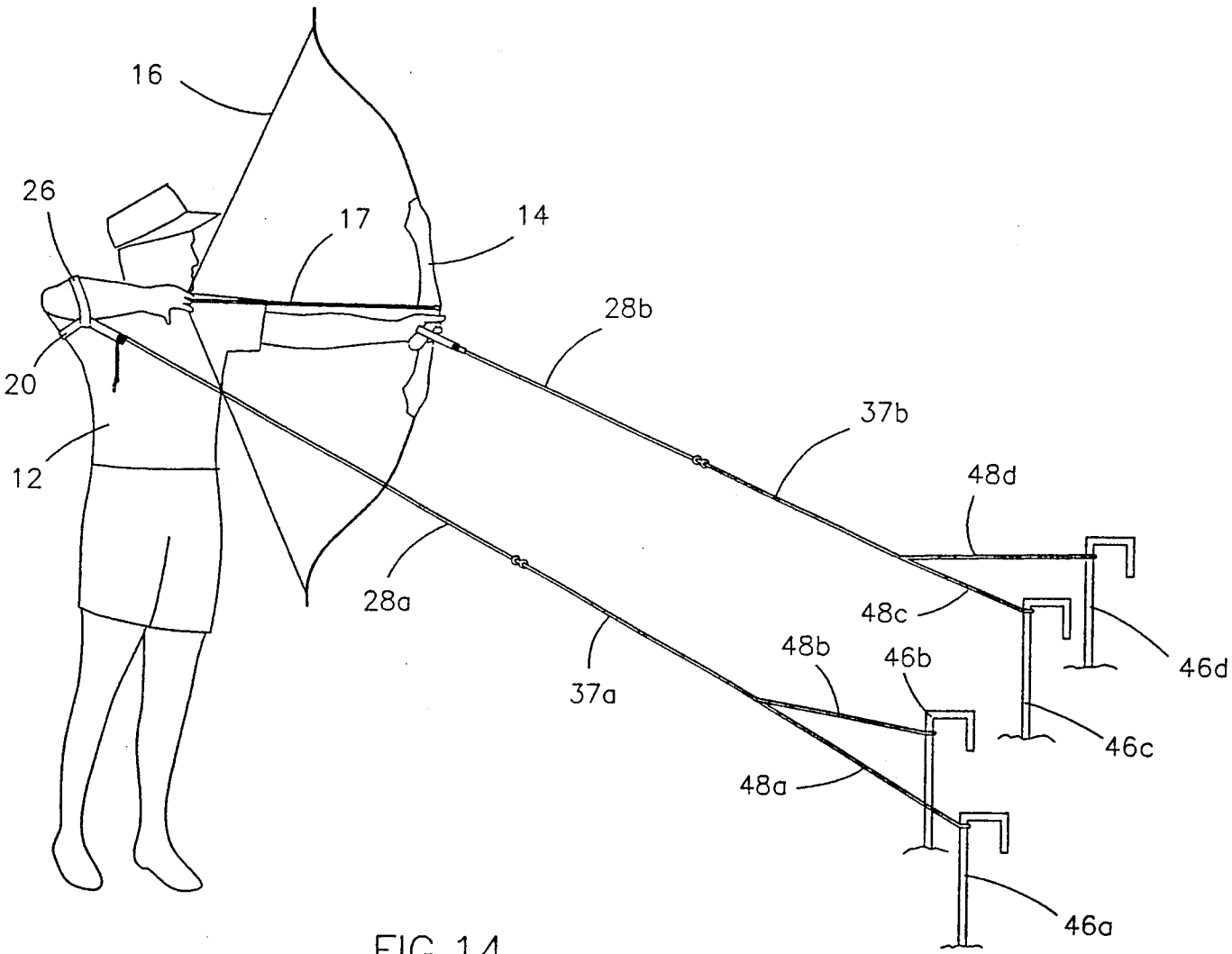
FIG. 14 illustrates the manner in which an archery training device is worn and used by the archer in accordance with a fourth embodiment of the present invention.

A fourth embodiment of the present invention shown in FIG. 14 entails elastically connecting the string arm connector 18 and the bow hand connector 38 to separate remote anchors **46*a* through 46*d* to independently induce a pair of lateral forces upon the string arm elbow 24 and the bow hand 15. A pair of elastomeric force carrying members 28*a* and 28*b*, respectively, which in turn are secured to the string arm connector 18 and bow hand connector 38, respectively. Preferably, each rope segment 37*a* and 37*b* divides at its end opposite its elastomeric force carrying member 28*a* and 28*b* to form ends 48*a* and 48*b*, and 48*c* and 48*d*, respectively. The ends 48*a*, 48*b*, 48*c* and 48*d* are then anchored to the ground by their respective posts 46*a*, 46*b*, 46*c* and 46*d*. As before, the pair of lateral forces imposed independently upon the string arm elbow 24 and the bow hand 15 requires the archer 12 to maintain upper body tautness, including added muscle force from the anchor hand 34, bow hand 15, shoulders 23 and 25 and string arm 22**, which promotes sustaining the dynamic push-pull balance throughout the shot.

FIGS. 15 and 16 depict a further feature of the invention wherein ends 43 of the elastomeric force carrying member 28 are fitted with a bushing 44 to improve the manner in which the elastomeric force carrying member 28 is secured to the string arm connector 18 and the bow hand connector 38. As seen in FIG. 15, at least one end 43 of the elastomeric force carrying member 28 is provided with a hole 41 through its tubular wall. A loop 47 is formed in the end 43 of the elastomeric force carrying member 28 by first forcing the opposite end (not shown) of the elastomeric force carrying member 28 through the end opening 45 and then pulling the opposite end through the hole 41 to form the loop 47. Continued pulling of the opposite end through the hole 41 reduces the size of the loop 47 until the bushing 44 will closely fit within the loop 47, as seen in FIG. 16. By pulling the loop 47 sufficiently tight, the bushing is securely retained within the loop 47 by the elastic nature of the elastomeric force carrying member 28. The above procedure results in a loop 47 which is sufficiently strong and secure for reliably retaining the bushing 44 on the end of the elastomeric force carrying member 28 without the need for additional bonding, crimping or fastening devices. Moreover, the loop 47 can be readily adjusted or undone for replacement or repair without special tools.

By repeated use of the archery training device 10 of any of the above embodiments and particularly the preferred embodiment of FIGS. 13 and 17, the archer is aided in his or her attempt to attain a perfect shot. The perfect shot is characterized by coplanar movement of the points A through C (FIGS. 1 through 3) from the beginning of bowstring release to the point at which the arrow 17 clears the bow 14 and the bow force is dissipated. The elastomeric force carrying member 28 sustains constant tensional forces upon the string arm elbow 24 and the bow hand 15 which compensates to some degree for the loss in bow force after the shot, thereby requiring the archer 12 to maintain proper muscular control, muscle force and body positioning before, during, and after string release. More specifically, the archery training device 10 of the present invention promotes the dynamic push-pull balance between the string arm elbow 24 and the bow hand 15 while also providing feedback of this balance when shooting arrows. Simultaneously, the archery training device 10 also reduces the effects of the reflex muscle relax time and promotes proper positioning of the anchor hand 34, bow hand 15, string arm elbow 24, and shoulders 23 and 25 of the archer within the rigid frame plane $\alpha$ when he or she is drawing and releasing the bowstring. The archery training device 10 achieves the above aspects while also permitting the archer 12 to shoot the arrow 17 to allow the placement of the arrow 17 to serve as a distinct form of feedback as to his or her push-pull balance and stance. Thus, repeated practice with the archery training device 10 teaches the archer proper upper body rear muscular control and body positioning for accurate shooting in a manner that was not heretofore possible.

In the preferred method for using the archery training device 10 of any one of the embodiments, the archer 12 first warms up without the archery training device 10 until he or she is hitting the center of a designated target. The archer 12 then places the string arm connector 18 upon his or her string arm 22 to straddle the string arm elbow 24 and places the bow hand connector 38 or glove 58 upon his or her bow hand 15. In the first two embodiments of FIGS. 9 and 10 and the preferred embodiment of FIG. 17, the length of the elastomeric force carrying member 28 is either pre-sized (FIGS. 9 and 17) or adjusted (FIG. 10) to produce at least a one pound force tensional load when the archer 12 is in a full draw position, as seen in FIG. 12. More preferably, the length of the elastomeric force carrying member 28 is such that four to five pound force tensional forces are imposed upon both the string arm elbow 24 and the bow hand 15 when the archer 12 is in a full draw position. In the embodiments of FIGS. 13 and 14, the location of the post 46 or posts **46*a* through 46*d* relative to the archer 12 determines the effective length of the elastomeric force carrying member 28. Again, a four to five pound force tensional load is preferred on both the string arm elbow 24 and the bow hand 15 when the archer 12** is in a full draw position.

The archer 12 then draws the bow 14 to the full draw position (FIG. 12) with an arrow 17 to place the elastomeric force carrying member 28 in tension by establishing a parallel force or the use of a preferred remote anchor. When the archer 12 has correctly aimed the arrow 17 at the target, he or she releases the bowstring 16 to shoot the arrow 17. The above is repeated until a consistent group of arrows 17 has been shot using the archery training device 10, with particular attention to the grouping of the arrows 17. If the arrow grouping is tight and in the center of the target, the archer's push-pull balance and reflex muscle relax time is correct. If the arrow group is not tight and not centered on the target, the archer's push-pull balance or reflex muscle relax time is incorrect. The archer 12 should then continue shooting arrows 17 until the arrow grouping is tight, though not necessarily centered on the target.

Once the arrow grouping is tight, the archer 12 adjusts his or her sight pin (not shown) to compensate for the distance that the arrow grouping is off the center of the target. Then, without the archery training device 10, the archer 12 again shoots a group of arrows 17 at the target. If the arrow grouping is tight and centered on the target, the archer 12 has attained a correct push-pull balance and reflex muscle relax time through muscle memory. If the arrow grouping is again either not tight or off center, additional practice is required until the muscle memory is attained which will enable the archer 12 to retain the proper muscle tautness and positioning and thereby maintain the correct push-pull balance throughout the shot.

As noted previously, a significant advantage to the use of the archery training device 10 of the present invention is that the constant tensional force generated by the elastomeric force carrying member is transferred to the string arm 22, the string arm elbow, the anchor hand 34, the bow hand 15, the shoulders 23 and 25, and the remaining parts of the entire upper body framework. The force exerted on the upper body by the elastomeric force carrying member 28 is constant between the full draw position and the released position, requiring the archer 12 to push and pull his upper body muscles so that they work throughout the duration of the shot. This not only necessitates that the archer 12 maintain a proper push-pull balance throughout the shot, but also minimizes the reflex muscle relax time as defined earlier, which together improve both the accuracy and consistency of shooting with repeated practice.

In addition, in the preferred embodiment the nature of the elastomeric force carrying member 28 specifically provides ample length between the string arm connector 18 and the bow hand connector 38 so as not to interfere with the draw of the bowstring 16. Accordingly, the full draw position of the archer 12 is not limited by the length of an inelastic force carrying member, as is taught in the prior art.

Another significant advantage of the present invention is that the archery training device 10 provides the archer 12 with distinct feedback pertaining to his or her push-pull balance, upper body position and reflex muscle relax time before, during and after the bowstring release. This feedback is in the form of movement of the elastomeric force carrying member 28 during the shot, and also the grouping of the arrows shot, permitting the archer 12 to assess his or her improvement by noting the tightness and spatial relationship of each arrow grouping. A correct push-pull balance and reflex muscle relax time is indicated when each arrow group is tight and at the center of the target.

While the invention has been described in terms of a preferred embodiment, it is apparent that other forms could be adopted by one skilled in the art. For example, variations in the manner in which the string arm connector 18 is designed to straddle the string arm elbow 24 could be made. Additionally, other means for creating a tensional force, either lateral or in line, upon the string arm elbow 24 and bow hand 15 could be adopted by those skilled in the art to achieve the muscular positioning and force balance as described. Accordingly, the scope of the invention is to be limited only by the following claims.

What is claimed is:

1. An archery training device for teaching an archer proper muscular control while shooting a bow and arrow so as to produce proper body positioning of the archer's back, shoulders, string arm, bow arm and bow hand along a rigid frame plane, said muscular control providing a push-pull balance that prevents collapse of said string arm and bow arm before, during and after release of said arrow, said archery training device comprising:

a string arm connector having an upper securing means and a lower securing means, said upper securing means being securable to an upper arm portion of said string arm, said lower securing means being securable to a forearm portion of said string arm, said upper securing means and said lower securing means cooperating together to prevent shifting of said string arm connector upon said string arm;

a bow hand connector secured to said bow hand, said bow hand connector having means for securing said bow hand connectir to said bow hand of said archer; and extendable means having one end attached to said string arm connector and an opposite end attached to said bow hand connector so as to permit extension therebetween and impose a side force upon said string arm connector and said bow hand connector such that when said string arm is in a fully drawn position said extendable means imposes an elastic tensional force upon both said string arm connector and said bow hand connector;

whereby said extendable force imposing means creates a first and second tensional force upon said string arm and bow hand, respectively, forcing muscles of said back, shoulders, string arm, bow arm and bow hand to remain taut while said bow is being drawn and after release of said arrow to maintain muscles of said back, shoulders, string arm and bow hand along said rigid frame plane and to maintain said push-pull balance, said push-pull balance preventing collapse of said string arm and bow arm during and after release of said arrow, said collapse otherwise adversely affecting said archer's ability to accurately shoot said arrow with said bow.

2. The archery training device of claim 1 wherein said upper securing means is an upper loop and said lower securing means is a lower loop in said string arm connector.

3. The archery training device of claim 1 wherein said upper securing means and said lower securing means are both secured adjacent the elbow of said string arm.

4. The archery training device of claim 1 wherein said upper securing means and said lower securing means are joined at a slip loop, said slip loop being slidably adjustable upon said string arm connector to provide adjustment of said string arm connector upon said string arm.

5. The archery training device of claim 1 further comprising adjustment means at said string arm connector for adjusting the length of said extendable means.

6. The archery training device of claim 1 wherein said bow hand connector is a glove sized to fit said bow hand of said archer.

7. The archery training device of claim 1 wherein said extendable means is non-adjustable.

8. The archery training device of claim 1 wherein said extendable means is an elastomeric member having one end attached to said string arm connector and an opposite end attached to said bow hand connector.

9. An archery training device for teaching an archer proper muscular control and body positioning of the archer's back, shoulders, string arm, bow arm and bow hand along a rigid frame plane while shooting a bow and arrow, said muscular control providing a push-pull balance that prevents collapse of said string arm and bow arm during and after release of said arrow, said archery training device comprising:

a string arm connector comprising an upper securing means and a lower securing means, said upper securing means being securable to an upper arm portion of said string arm, said lower securing means being securable to a forearm portion of said string arm, said upper securing means and said lower securing means cooperating together to prevent shifting of said string arm connector upon said string arm;

a bow hand connector comprising means for securing said bow hand connector to said bow hand of said archer; and means attached to said string arm connector and said bow hand connector for imposing a load upon said string arm connector and said bow hand connector, said load being imposed in a direction which is not parallel to a line between said string arm connector and said bow hand;

whereby said load imposing means creates a first and second tensional force upon said string arm and bow hand, respectively, said first and second tensional forces forcing muscles of said back, shoulders, string arm, bow arm and bow hand to remain taut to maintain said back, shoulders, string arm and bow hand along said rigid frame plane and to maintain said push-pull balance, said push-pull balance preventing collapse of said string arm and bow arm after release of said arrow, said collapse otherwise adversely affecting said archer's ability to accurately shoot said arrow with said bow.

10. The archery training device of claim 9 further comprising at least one remote anchoring object, wherein said load imposing means tensionally connects said string arm connector and said bow hand connector to said at least one remote anchoring object.

11. The archery training device of claim 10 wherein said load imposing means is an elastomeric member attached to said string arm connector, said elastomeric member having means for securing said elastomeric member to said at least one remote anchoring object.

12. The archery training device of claim 10 wherein said load imposing means is an elastomeric member attached to said bow hand connector, said elastomeric member having means for securing said elastomeric member to said at least one remote anchoring object.

13. The archery training device of claim 10 further comprising extendable means attached to said string arm connector and said bow hand connector so as to permit elastic extension therebetween while said bow is being drawn to shoot said arrow, and wherein said load imposing means comprises a unitary member attached to said extendable means and said at least one remote anchoring object.

14. The archery training device of claim 13 wherein said unitary member is a rope segment.

15. The archery training device of claim 10 further comprising first and second rope portions attached to said load imposing means, said first and second rope portions being adapted for securing said load imposing means to said at least one remote anchoring object.

16. The archery training device of claim 10 wherein said at least one remote anchoring object comprises a stake anchored in the ground.

17. The archery training device of claim 10 wherein said at least one remote anchoring object comprises a pair of stakes anchored in the ground, said load imposing means being attached to both a first of said pair of stakes and a second of said pair of stakes.

18. The archery training device of claim 9 wherein said upper securing means is an upper loop in said string arm connector and said lower securing means is a lower loop in said string arm connector.

19. The archery training device of claim 9 wherein said upper securing means and said lower securing means are both secured adjacent the elbow of said string arm.

20. The archery training device of claim 9 wherein said upper securing means and said lower securing means are joined at a slip loop, said slip loop being slidably adjustable upon said string arm connector to provide adjustment of said string arm connector on said string arm.

21. The archery training device of claim 9 wherein said bow hand connector is a glove sized to fit said bow hand of said archer.

* * * * *

UNITED STATES PATENT AND TRADEMARK OFFICE

CERTIFICATE OF CORRECTION

PATENT NO. : 5,277,170

DATED : January 11, 1994

INVENTOR(S) : Richard F. Carella

It is certified that error appears in the above-identified patent and that said Letters Patent is hereby corrected as shown below:

Column 1, line 66, delete "a" insert ---- α ----.

Column 2, line 6, delete "grame" insert ---- frame ----.

Column 11, line 56, after "A" insert ---- pair of rope segments 37a and 37b are attached to a corresponding ----.

Column 14, line 58, delete "connectir" insert ---- connector ----.

Signed and Sealed this

Fourteenth Day of June, 1994

Bruce Lehman

BRUCE LEHMAN

*Commissioner of Patents and Trademarks*

*Attest:*

*Attesting Officer*